US009903337B2

(12) United States Patent
Ikeda

(10) Patent No.: US 9,903,337 B2
(45) Date of Patent: Feb. 27, 2018

(54) PLASMA GENERATOR AND INTERNAL COMBUSTION ENGINE

(71) Applicant: IMAGINEERING, INC., Kobe-shi, Hyogo (JP)

(72) Inventor: Yuji Ikeda, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 0 days.

(21) Appl. No.: 14/915,761

(22) PCT Filed: Sep. 2, 2014

(86) PCT No.: PCT/JP2014/072966

§ 371 (c)(1),
(2) Date: Jun. 6, 2016

(87) PCT Pub. No.: WO2015/030247

PCT Pub. Date: Mar. 5, 2015

(65) Prior Publication Data

US 2016/0281674 A1 Sep. 29, 2016

(30) Foreign Application Priority Data

Sep. 2, 2013 (JP) ..... 2013-181700

(51) Int. Cl.
*F02P 23/04* (2006.01)
*H05H 1/46* (2006.01)
(Continued)

(52) U.S. Cl.
CPC ..... *F02P 23/045* (2013.01); *F02P 3/02* (2013.01); *H01T 13/02* (2013.01); *H05H 1/46* (2013.01);
(Continued)

(58) Field of Classification Search
CPC .. F02P 23/04; F02P 23/045; F02P 3/02; F02P 3/0435; H01T 13/02; H01T 13/04;
(Continued)

(56) References Cited

U.S. PATENT DOCUMENTS 8,226,901 B2 * 7/2012 Makita ..... F02P 3/01 123/143 B
8,861,173 B2 * 10/2014 Ikeda ..... F02P 3/01 361/253
(Continued)

FOREIGN PATENT DOCUMENTS

JP 2008-082286 A 4/2008
JP 2012-219748 A 11/2012

*Primary Examiner* — Hai Huynh
(74) *Attorney, Agent, or Firm* — Westerman, Hattori, Daniels & Adrian, LLP

(57) ABSTRACT

Plasma generator has an ignition coil for supplying a discharge voltage, an electromagnetic wave oscillator that generates electromagnetic waves, a mixer that mixes energy for discharge with electromagnetic wave energy, and an ignition plug that causes a discharge and introduces the electromagnetic wave energy to a reaction region. The discharge and electromagnetic wave energy are used together in the reaction region, wherein a combustion reaction or plasma reaction is carried out, triggering a combustion reaction or plasma reaction. Part of a member that constitutes the ignition plug is used as part of a member that forms the mixer.

11 Claims, 6 Drawing Sheets

(51) Int. Cl.

| | |
|---|---|
| ***H05H 1/52*** | (2006.01) |
| ***F02P 3/02*** | (2006.01) |
| ***H01T 13/02*** | (2006.01) |
| *H01T 13/04* | (2006.01) |
| *F02P 3/04* | (2006.01) |

(52) U.S. Cl.
CPC ..... *H05H 1/52* (2013.01); *F02P 3/0435* (2013.01); *H01T 13/04* (2013.01); *H05H 2001/463* (2013.01); *H05H 2001/4607* (2013.01); *H05H 2001/4682* (2013.01)

(58) Field of Classification Search
CPC .... H05H 1/46; H05H 1/52; H05H 2001/4607; H05H 2001/463; H05H 2001/4682
USPC ..... 123/143 B; 361/247
See application file for complete search history.

(56) References Cited

U.S. PATENT DOCUMENTS

| | | | | |
|---|---|---|---|---|
| 9,169,820 | B2 * | 10/2015 | Yamada | F02P 3/04 |
| 9,506,447 | B2 * | 11/2016 | Ikeda | F02P 7/02 |
| 9,587,618 | B2 * | 3/2017 | Ikeda | F02P 3/01 |
| 9,638,158 | B2 * | 5/2017 | Ikeda | F02P 9/007 |
| 9,677,534 | B2 * | 6/2017 | Ikeda | F02B 9/00 |
| 2016/0181765 | A1 * | 6/2016 | Ikeda | H01T 13/40 315/111.41 |

* cited by examiner

PLASMA GENERATOR AND INTERNAL COMBUSTION ENGINE

TECHNICAL FIELD

The present invention relates to a plasma generator and an internal combustion engine.

BACKGROUND

Plasma generator that creates local plasma using discharge of ignition plug and then enlarges this plasma using EM (Electro Magnetic) waves such as microwaves has been developed (see JP 2009-036198 A1). In this plasma generator, mixing circuit is provided for mixing the energy for discharging and energy of EM wave from EM wave generator. Mixing circuit is connected to an input terminal of the ignition plug. EM wave energy and high voltage pulses are thereby superimposed in a same transmission line and are supplied to the ignition plug. Ignition plug can therefore serve as both discharge electrode and EM wave radiating antenna.

However, the conventional plasma generator has a drawback for allocating a space for mixing circuit in a restricted space inside an engine because the mixing circuit is usually arranged on the ignition plug.

PRIOR ART DOCUMENTS

Patent Document

Patent Document 1: JP 2009-0361198 A1

SUMMARY OF INVENTION

Problems to Be Solved

The present invention is made in view of this respect. The objective of the present invention is to downsize a plasma generator equipping mixing circuit and to allow a convenient installation in restricted space inside an engine.

Measures for Carrying Out the Invention

A plasma generator includes an ignition coil for supplying a discharge voltage;

an EM-wave oscillator for oscillating EM waves;

a mixer for mixing an energy for discharge and an EM wave energy; and an ignition plug that causes discharge and for introducing the EM wave energy to a reaction region where a combustion reaction or a plasma reaction is carried out.

The plasma generator initiates the combustion reaction and the plasma reaction in the reaction region using energies of discharge and EM waves.

The plasma generator is characterized in that part of a component constituting the ignition plug is used as a part that forms the mixer.

The plasma generator of the present invention can compactly arrange a mixer near the ignition plug because a part of a component that constitutes the ignition plug is used as a part that constitutes the mixer. This allows a downsizing of the plasma generator itself. The power loss can be reduced also in the transmission line connecting the mixer and the ignition plug.

The part of the component constituting the ignition plug is preferably an insulator part of the ignition plug, a center electrode, or a terminal. The insulator (insulator part) and the conductor (terminal and center electrode) can be used efficiently as a part of a mixed circuit in the mixer.

The mixer preferably employs a capacitive coupling or a combination of capacitive coupling and inductive coupling. EM wave energy and discharge voltage can be mixed efficiently by applying the above method as a coupling method of EM wave energy and discharge voltage.

The capacitive coupling preferably employs a capacitor configured by tip part of a tabular transmission path of the mixer connected to the EM wave oscillator and a center electrode of the ignition plug. The capacitor used in conventional mixer for capacitive coupling system was configured by center electrode portion of mixer and tubular transmission path. On the contrary, the present invention allows a compact arrangement of the mixer near the ignition plug. Tip part of tubular transmission path and center electrode of ignition plug constitute a capacitor by an intervention an insulator part of the ignition plug which is made by high dielectric constant materials such as ceramics. This allows a compact and high efficiency capacity coupling.

Resonator fox preventing EM wave leakage shall be provided on a circuit connecting the ignition coil and mixer. EM wave leakage prevention resonator can prevent EM waves from leaking toward the ignition coil from the mixing circuit. Damages in ignition coil and power loss can thereby be prevented.

Resonator preferably employs a resonance structure of either quarter electricity length of even order harmonic waves or quarter electricity length of odd order harmonic waves. Such resonance structure can prevent EM waves from leaking in mixer much efficiently. If resonance structures of quarter electricity length of even order harmonic wave and odd order harmonic wave are employed, the leakage of even order waves, which may occur, can be prevented stably when microwaves of 2.45 GHz are outputted from the EM wave oscillator.

In the plasma generator of the present invention, the resonance frequency shall be adjustable by adjusting the position, inner diameter, outer diameter, length, thickness, or dielectric constant of the resonator. Leakage of EM waves can be prevented efficiently according to the reaction state inside the combustion chamber by thus adjusting the resonance frequencies. The resonator can be arranged inside the mixer, on high voltage pulse (energy: for discharge) input portion, or on both of them. In the latter case, resonance structure of quarter electricity length of resonance frequency of even order harmonic wave can be provided on one side, and the resonance structure for odd order waves can be provided on the other side.

Plasma generator of the present invention can arrange an EM wave exterior leakage prevention component on the inner circumference surface of plughole for attaching ignition plug or on the outer circumference surface of plasma generator. This prevents EM waves from leaking outside of the plughole even when a clearance is formed between exterior tip of plasma generator and plughole, and EM waves leak from exterior tip of plasma generator.

The plasma generator of the present invention preferably employs a resonating circuit, that resonate EM waves oscillated from the EM wave oscillator. The resonating circuit allows an adjustment for the plasma genera for to improve the transmission efficiency of the EM waves oscillated from the EM wave oscillator.

The resonating circuit preferably employs a resonance structure of quarter electricity length of the EM wave oscillated from the EM wave oscillator. The resonance structure of the resonating circuit thus allows the plasma generator to further improve the transmission efficiency of the EM waves.

Amplifying circuit for amplifying the EM wave outputted from the EM wave oscillator can be further employed. Stub, having width of ⅛ electricity length of the EM waves oscillated from the EM wave oscillator, can be provided in the center path of the amplifier. This can stably prevent the leakage of even order waves, which may occur when microwaves of 2.45 GHz are outputted from the EM wave oscillator.

The present invention also includes an internal combustion chamber comprising the above mentioned plasma generator. The internal combustion engine of the present invention can reduce the EM wave energy loss in the transmission line from the EM wave oscillator to the ignition plug by an employment of the plasma generator, allowing an improvement of the combustion efficiency.

Advantage of the Invention

The present invention affords a plasma generator equipping a mixing circuit which can downsize the plasma generator by allowing the mixing circuit to be located near a spark plug and allows plasma generator to be arranged in a restricted space inside an engine. The plasma generator of the present invention can reduce discharge energy loss and EM wave energy loss because the mixer and ignition plug are connected directly.

BRIEF DESCRIPTION OF THE DRAWINGS

FIG. 2 shows the prevent diagrams of plasma generators according to the embodiments.

DESCRIPTION OF THE PREFERRED EMBODIMENTS

Figure 1:
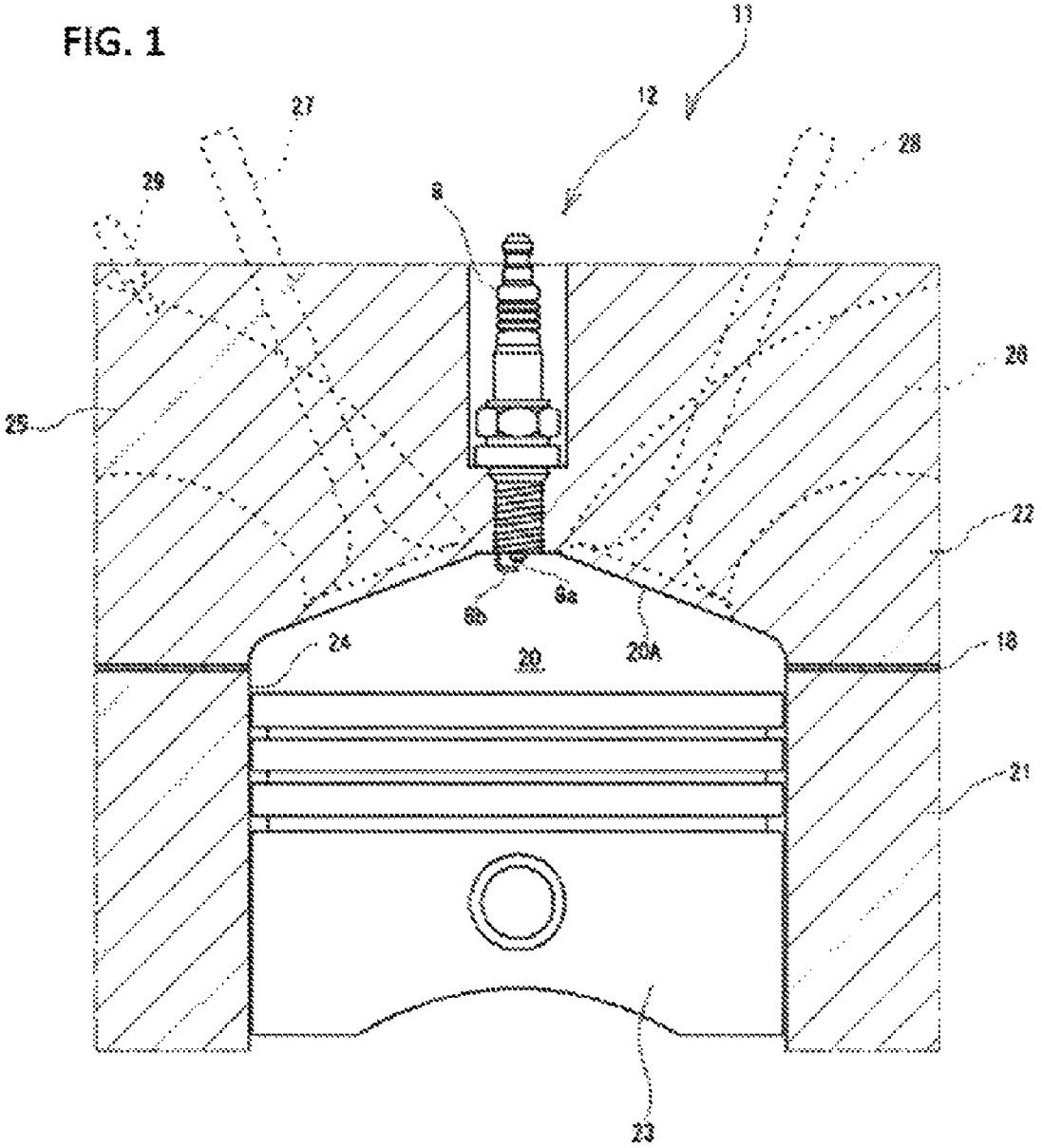
FIG. 1 is a sectional view of an internal combustion engine according to an embodiment.

The embodiments of the present invention are detailed with reference to the accompanying drawings. The embodiments below are the preferred embodiments of the invention, but are not intended to limit the scope of present invention and application or usage thereof.

First Embodiment

Internal Combustion Engine

The present embodiment relates to an internal combustion engine including internal combustion engine body 12 and plasma generator 1 of the present invention. In internal combustion engine 11, plasma generator 1 creates local plasma using discharge of a ignition plug, and promotes a combustion reaction by enlarging this plasma using EM waves (this will be referred to as "microwave" in the embodiments of the present invention). Mixing circuit 6 of this plasma generator 1 uses center electrode 8*a* and insulator part 80 of ignition plug 8 as a part of the component and is compactly arranged on the ignition plug.

Internal Combustion Engine Body

As shown in FIG. 1, internal combustion engine body 12 includes cylinder prevent 21, cylinder head 22, and piston 23. Multiple cylinders 24 with a circular cross section are formed in cylinder prevent 21. Piston 28 is formed in each cylinder 24 so as to reciprocate freely. Piston 23 is connected with crankshaft via connecting rod (not illustrated). The crankshaft is supported rotatable by cylinder prevent 21. Connecting rod converts reciprocation of piston 23 to rotation of crankshaft when piston 23 reciprocates in each cylinder 24 in the axial direction of cylinder 24.

Cylinder head 22 is located on cylinder prevent 21 sandwiching gasket 18. Cylinder head 22 constitutes a defining component that defines circular sectioned combustion chamber 20, together with cylinder 24, piston 23, and gasket 18.

One ignition plug 8 is provided for each cylinder 24 in cylinder head 22. As shown in FIG. 1, tip part of ignition plug 8 exposed to combustion chamber 20 is located in the center part of ceiling surface 20A (the surface exposed to combustion chamber 20 of cylinder head 22) of combustion chamber 20. Ttip part of ignition plug 8 is provided with tip 8*a'* of center electrode 8*a* and earth electrode 8*b*. Discharge gap is formed between tip 8*a'* of center electrode 8*a* and earth electrode 8*b*.

Inlet port 25 and exhaust port 26 are formed in cylinder head 22 for each cylinder 24. Inlet port 25 is provided with intake valve 27 for opening and closing the intake side opening of inlet port 25 and injector 29 for injecting fuel. Exhaust port 26 is provided with exhaust valve 28 for opening and closing the exhaust side opening of exhaust port 26. Inlet port 25 of internal combustion engine 11 is designed so that an intense tumble flow is formed in combustion chamber 20. Internal combustion engine 11 is not limited to a reciprocating type internal combustion engine.

Plasma Generator

Figure 2A:
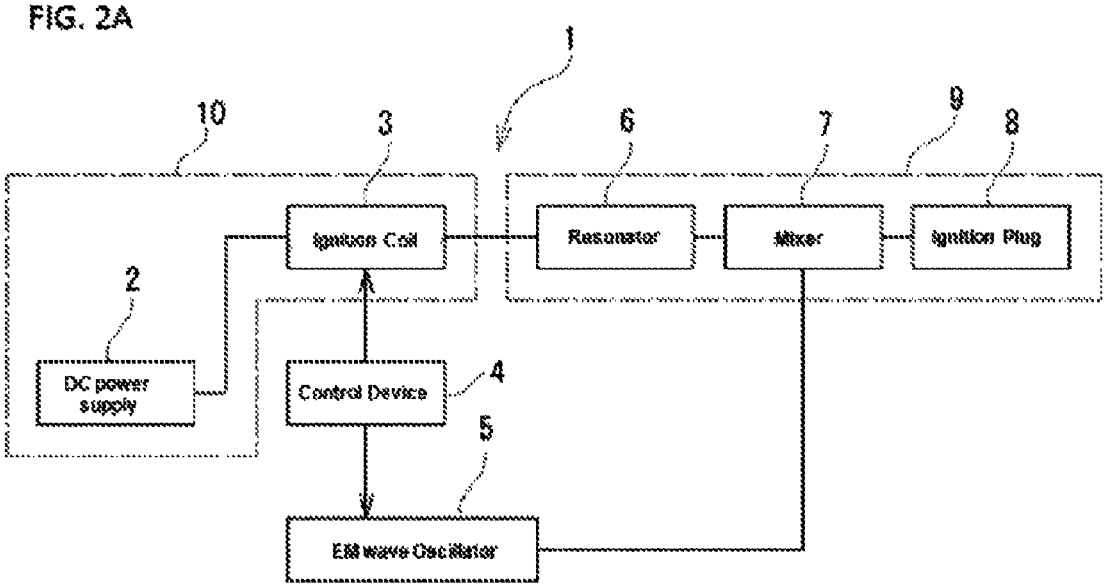
FIG. 2A is the prevent diagram of the first embodiment.
Figure 2B:
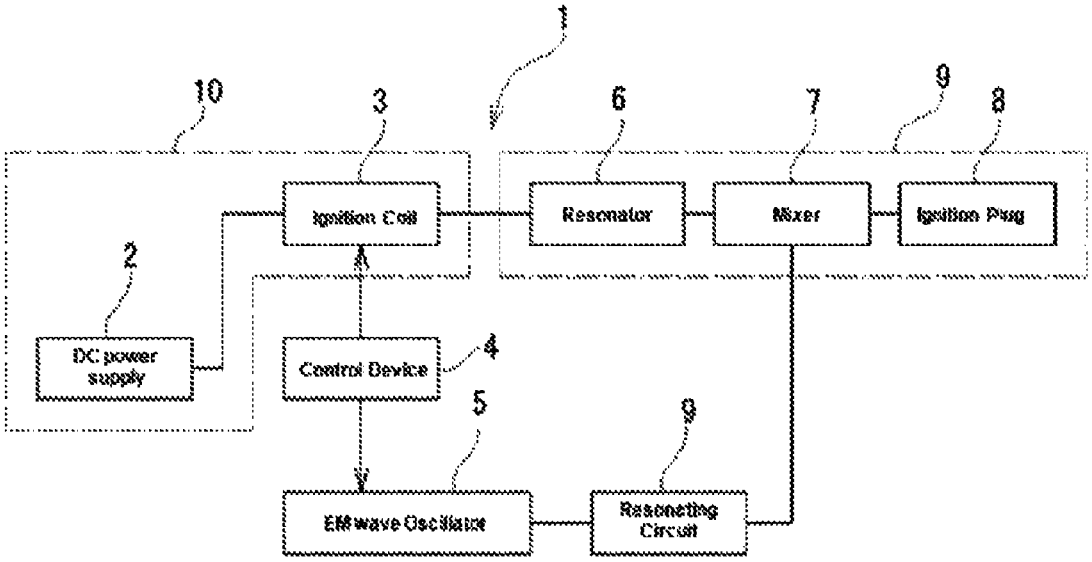
FIG. 2B is the prevent diagram of the third embodiment.

Plasma generator 1 of the present embodiment includes control device 4, high voltage pulse generator 10, EM wave oscillator 5 and ignition part 9 as shown in FIG. 2A. High voltage pulse generator 10 is made of DC (Direct Current) power supply 2 and ignition coil 3. Ignition part 9 includes resonator 6, mixer 7, and ignition plug 8. Each of energy oscillated from high voltage pulse generator 10 and EM wave oscillator 5 is transmitted to ignition part 9. Mixer 7 of ignition part 9 mixes the energies provided from high voltage pulse generator 10 and EM wave oscillator 5 with time interval.

The energy mixed in mixer 7 is supplied to ignition plug 8. The energy of high voltage pulse supplied to ignition plug 8 causes a spark discharge in a gap between tip 8*a'* of center electrode 8*a* and earth electrodes 8*b* of ignition plug 8. The energy of microwaves oscillated from EM wave oscillator 5 enlarges and maintains the discharge plasma generated by the spark discharge. Control device 4 controls DC power supply 2, ignition coil 3, and EM wave oscillator 5; and adjusts the timings of the discharge of ignition plug 8 and injection of microwave energy to achieve an intended combustion state.

High Voltage Pulse Generator

High voltage pulse generator 10 include DC power supply 2 and ignition coil 3. Ignition coil 3 is connected to DC power supply 2. Ignition coil 3 amplifies the voltage applied from DC power supply 2 when an ignition signal in received from control device 4. The amplified high voltage pulse is outputted to ignition part 9 equipping resonator 6, and mixer 7, and ignition plug 8.

Figure 3:
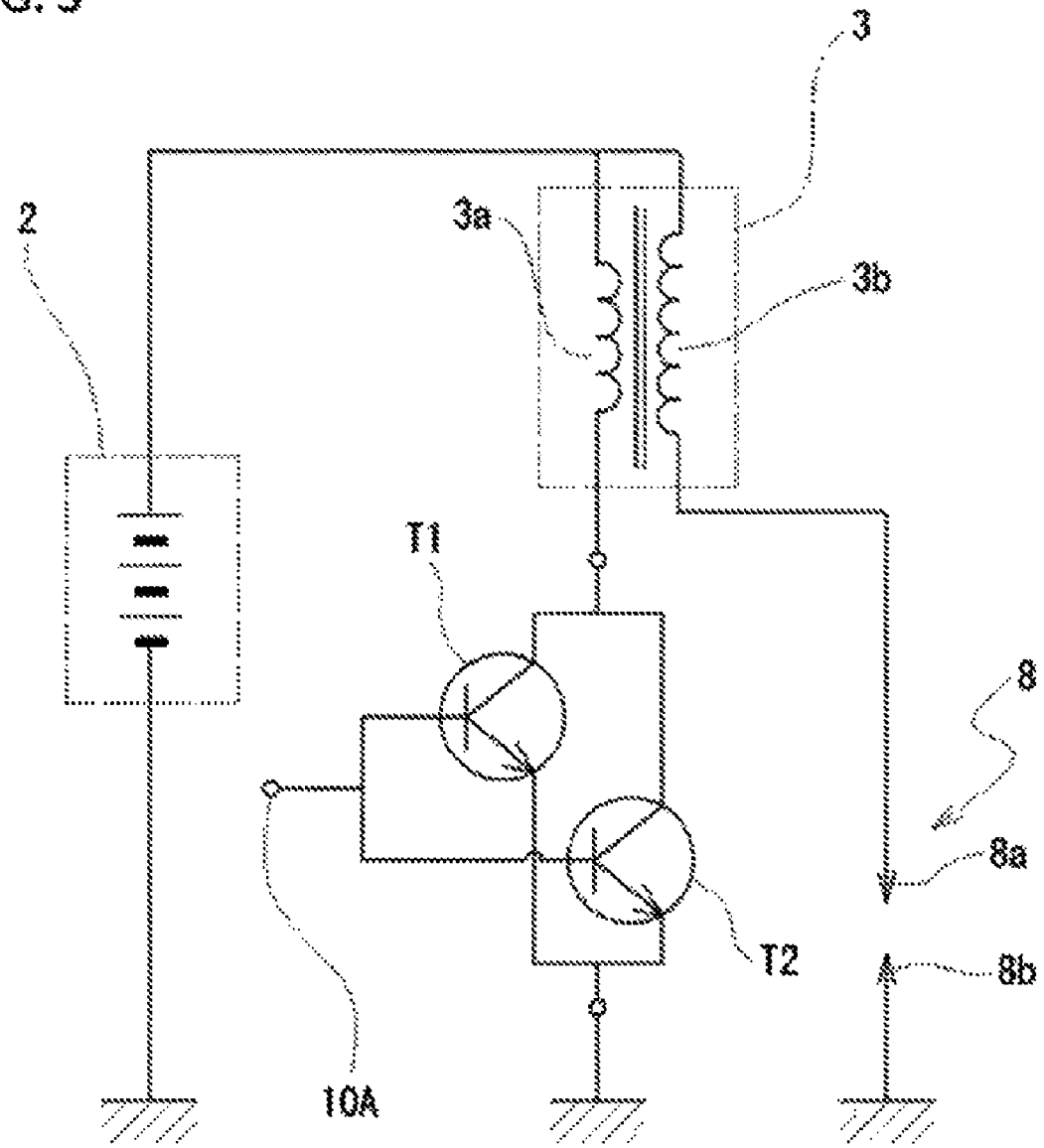
FIG. 3 illustrates an operation of a high voltage pulse generator of an embodiment.

Operation of high voltage pulse generator 10 will be discussed based on FIG. 3. When a signal is inputted to terminal 10A of high voltage pulse generator 10, transistors T1 and T2 are conducted, and the current thereby flows in coil 3*a*. When the signal of terminal 10A is turned off, the current of coil 3*a* is shut down and an excessive high voltage is induced in coil 3*b* due to counter electromotive force. Meanwhile, voltage arises in center electrode 8*a* of ignition plug 8 resulting a discharge in discharge gap between tip 8*a'* of center electrode 8*a* and earth electrodes 8*b* of ignition plug 8. Control device 4 is controlled so that the microwaves are generated after a predetermined period from the timing where the signal of terminal 10A is turned off. The microwave energy is thereby provided efficiently to plasma which is a group of gas ionized by the discharge, and plasma is then enlarged and expanded.

EM Wave Oscillator

Figure 4:
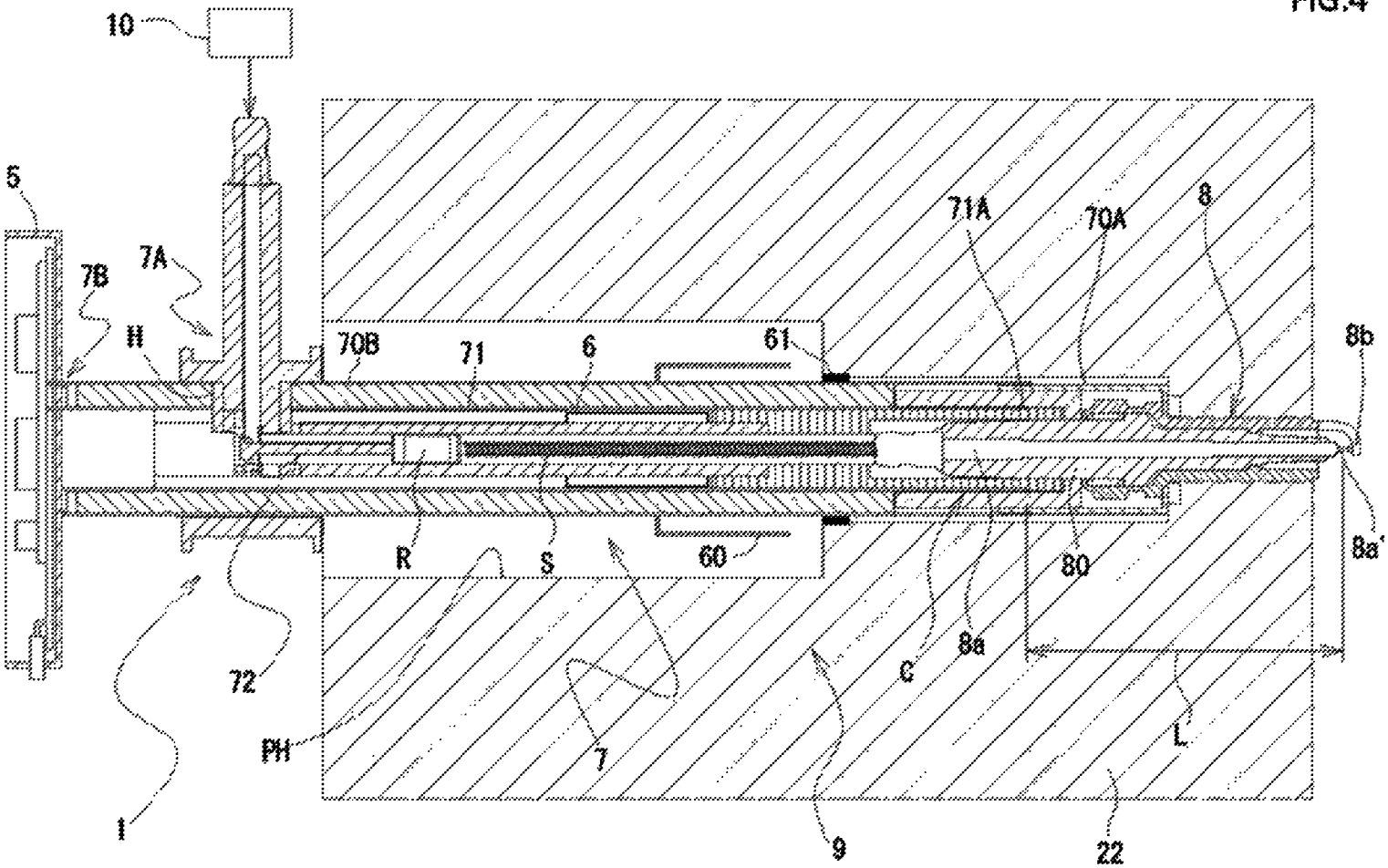
FIG. 4 is a sectional view of the entire plasma generator of an embodiment.

EM wave oscillator 5 outputs microwave pulses repetitively during a pulse width period of EM wave drive signal with a predetermined oscillation pattern when the EM wave drive signal is received from control device 4. Semiconductor generator generates microwave pulses in EM wave oscillator 5. The other generators such magnetrons can be used instead of the semiconductor generator. The microwave pulses are thereby outputted to mixer 7 of ignition part 9. FIG. 4 illustrates an example of the present embodiment where a single EM-wave oscillator 5 is arranged for one ignition plug 8, i.e., one cylinder. When there are multiple cylinders, e.g., four-cylinder internal combustion chamber, microwave pulses from one EM wave oscillator 5 can be branched to each plasma generator 1 using a branching means (not illustrated). In this case, microwaves are attenuated in the branching means such as switches. Therefore, the output from EM wave oscillator 5 shall be set to low level, (for example, 1 watt) and microwaves shall transmit the amplifier (not illustrated) prior to an input to mixer 7 in each plasma generator 1. For example, amplifiers such as power amplifier shall be arranged in the position of EM wave oscillator 5 of FIG. 4.

Ignition Part

Ignition part 9 includes resonator 6, mixer 7, and ignition plug 8. Energy generated in KM wave oscillator 5 is transmitted directly to mixer 7, while the energy generated in high voltage pulse generator 10 is transmitted to mixer 7 via resonator 6. Mixer 7 mixes the energies from EM wave oscillator 5 and high voltage pulse generator 10. Resonator 6 prevents microwave energy from leaking from mixer 7 toward ignition coil 3. Energy mixed in mixer 7 is supplied to ignition plug 8. High voltage pulse energy supplied to ignition plug 8 causes spark discharge in ignition plug 8. Microwave energy oscillated from EM wave oscillator 5 enlarges and maintains the discharge plasma created by the spark discharge.

Mixer

Mixer 7 receives high voltage pulses from high voltage pulse generator 10 and microwaves from EM wave oscillator 5 using separate input terminals 7A and 7B, and then outputs the high voltage pulses and microwaves to ignition plug 8 from same output terminal. Mixer 7 is thus configured so that the high voltage pulses and microwaves can be mixed. Input terminal 7A is connected electrically to high voltage pulse generator 10 in mixer 7, and input terminal 7B is connected electrically to EM wave oscillator 5.

Mixer 7 forms a coaxial structure with connection pipe 71 because outer case 70B is in earth potential. Electric field does not occur inside because connect ion pipe 71 is cylindrical. Microwaves thereby transmit between outer case 70B and connection pipe 71, and are supplied to tip part 71A of connection pipe 71. Tip part 71A and center electrode 8*a* of ignition plug 8 are capacity coupled by a resonant circuit formed from inductive element E of transmission line in connection pipe 71, and capacity element C1 between tip part 71A of connection pipe 71 and center electrode 8*a*. Capacitor configuring a capacitive coupling system will be discussed later. The resonance frequency f is described as follows.

$$f=1/(2\pi(E*C1)\hat{}(1/2))$$

In this case, there exists resistance element r of ignition plug 8 and capacity element C2 formed between connection pipe 71 and outer case 70B on the circuit, but influence on resonance is negligible because resistance element is very small. Resonance frequency f can therefore adjusted by changing the length of tip part 71A (length of capacitor in the axial direction configured by tip part 71A and center electrode 8*a*), or by changing the diameter of tip part 71A. Capacity of capacitor in the capacity coupling system is thus set to allow transmission of several gigahertz band microwaves and cut off short wavelength frequencies.

Configuration of mixer 7 will be discussed. As shown in FIG. 4, microwaves are supplied to cylindrical connection pipe 71. (microwave conduction pipe) and outer case 70B formed coaxially with connection pipe 71 in mixer 7. Outer diameter of connection pipe 71 is larger than outer diameter of ignition plug 8, and is inserted in insulator part 80 of ignition plug 8 using dielectric material. One end of connection pipe 71 can be grounded using conductive material of even multiples of λ/4 (λ stands for wavelength of a microwave, but sometimes λ will be referred to as electrical length.). Cutout hole H for arranging input terminal 7A is formed in the predetermined position of circumferences of outer case 70B and connection pipe 71. Outer case 70B is fitted and connected to grounding outer case 70A, covering insulator part 80, from the root side of screw portion of ignition plug 8. Metal meshed gasket for preventing EM wave leakage from the fitting portion shall be provided. Input terminal 7A, which will be high voltage supplying portion arranged at cutout hole H, has tip in the resonator 6 side which is fitted to high voltage transmission line 72. High voltage transmission line 72 is supported by an insulating material arranged coaxially with connection pipe 71 and contacting the inner surface of connection pipe 71. High voltage transmission line 72 shall be made of coiled spring S partially or entirely to withstand the mechanical vibration. Resistance substance R shall be connected to high voltage transmission line 72 for EM wave absorption and noise prevention.

Resonator 6 has an opening in the axial center along the inner diameter of connection pipe 71 so as to cover a part of high voltage transmission line 72. Distance between the opening of resonator 8 and tip of connection pipe 71 (fitting part with insulator part 80) is set to be the multiples of λ/2. Use of resonator 6 prevents microwaves from flowing toward ignition coil 3 because line impedance of high voltage transmission line 72 can be maintained high and impedance difference between the lines becomes large. Tip potential of connection pipe 71 is therefore increased further. As a result, high voltage power is superimposed by microwaves and is supplied efficiently to ignition plug tip. Configuration of resonator 6 is detailed later.

Plasma generator 1 employs a part of component constituting ignition plug 8 as a part of component forming mixer 7. Capacitor C, constituting the capacitive coupling system of mixer 7 of plasma generator 1, is configured, by tip 71A of cylindrical connection pipe 71 (tip part of a tubular transmission path) and center electrode 8*a* inside the ignition plug 8. Compact and efficient capacity connection system can be achieved because insulator part 80 made of high, dielectric constant ceramics is provided between tip 71A of connection pipe 71 and center electrode 8*a*. Distance L between tip 71A of connection pipe 71 and tip of center electrode 8*a* of ignition plug 8 shall be designed to multiples of λ/2 because the microwaves having anti-node at tip part 71A of connection pipe 71 can have anti-node also in the discharge gap. The microwave energy can therefore be provided to plasma efficiently.

High voltage power supplied from, the lateral surface is thus connected to terminal of Ignition plug 8 via high voltage transmission line 72. Microwaves are capacitive coupled between center electrode 8*a* and tip 71A of ignition plug 8 by configuring cylindrical connection pipe 71 so that the tip 71A surrounds ignition plug 8. Microwaves that are capacitive coupled to center electrode 8*a* are supplied to discharging tip part of ignition plug 8. Resonator 6 is arranged on the high voltage power supplied side and line impedance between the paths becomes high. This prevents microwaves from, flowing toward ignition coil 3 because microwaves are reflected and potential of connection pipe tip is further increased. As a result, high voltage power supply is superimposed by microwave and is supplied efficiently to ignition plug tip.

Resonator

Figure 6:
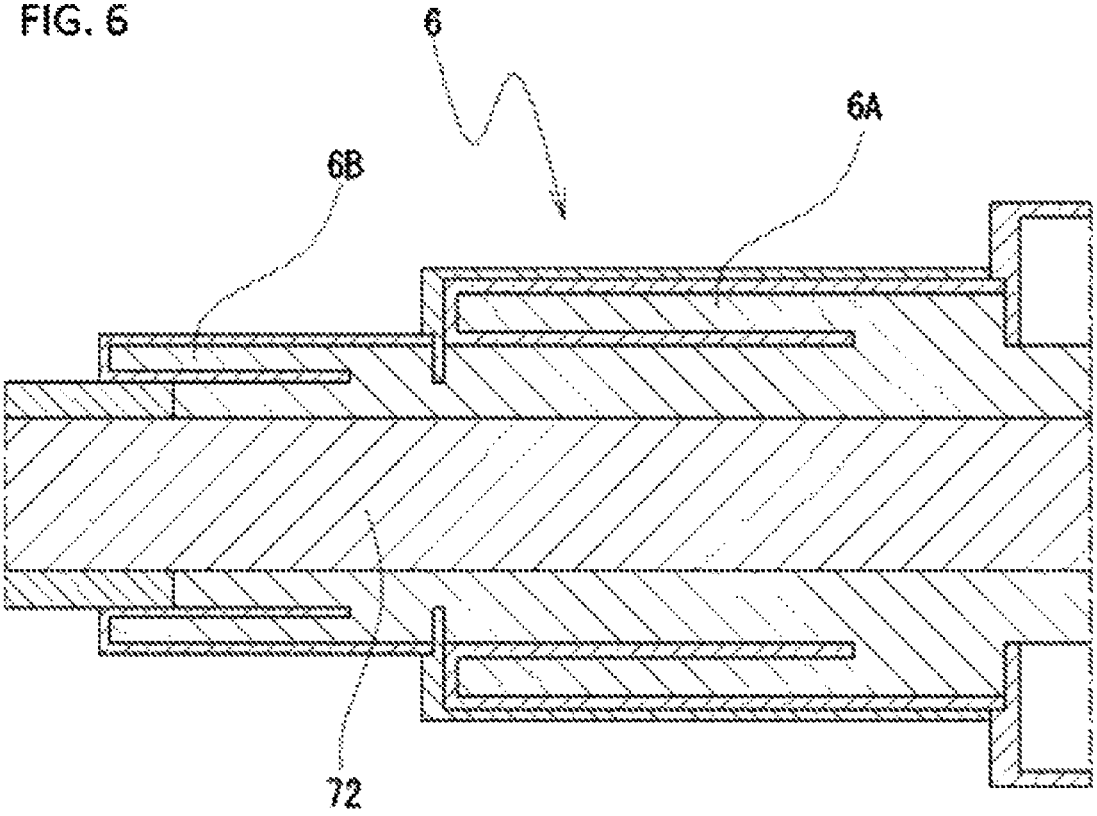
FIG. 6 is a sectional, view of a resonator of a plasma generator according to an embodiment.

Resonator 6 is a cavity resonator of coaxial structure, for example, and resonate the microwaves leaking toward ignition coil 3 from mixer 7. Leakage of microwaves toward ignition coil 3 can be suppressed using resonance inside resonator 6. Resonator 6 can have multiple resonance structures as shown in FIG. 6. As commonly known, only the microwave of specific frequency satisfying the resonance conditions can exist inside resonator 6. Therefore, an opening is provided in inner pipe of resonator 6 so that only the microwaves of specific frequency satisfying the resonance conditions can enter resonator 6 and form stationary waves. When resonator 6 is designed so that amplitude of stationary wave become maximum in the topmost part of resonator 6, phase between opening of resonator 6 and upper part of resonator 6 shifts 180 degrees. This minimizes the amplitude of microwaves not entering resonator 6. Leakage of microwaves can be prevented efficiently by adjusting the resonance structure to the size where microwaves of intended frequency band, e.g., 2.45 GHz, can resonate because resonance frequency is determined by length of resonance structure. Resonator 6 of FIG. 6 can be adjusted so that first resonator 6A has the size for resonating 2.45 GHz microwaves and that second resonator 6B has the size for resonating the other frequency hand waves such as 2.41 to 2.44 GHz or 2.46 to 2.49 GHz which are around 2.45 GHz, or microwaves of 4.9 GHz frequency band which is the multiple of 2.45 GHz. Second resonator 6B can also be adjusted to the size for resonating 2.45 GHz microwaves as well as first resonator 6A.

Structure of resonator 6 will be detailed. Resonance part of resonator 6 is made of dielectric material which is similar to insulation material of high voltage transmission line 72 or of material of equivalent dielectric constant. Conducting portion is formed by metals and is made by machining or plating. Resonance structure length of resonator 6 is designed to quarter wave of microwave wavelength λ. Wavelength in the dielectric substance can be adjusted by the relative dielectric constant. Size of resonator 6 can be determined therefore by constitutive dielectric substance and its resonance frequency and size can be reduced by selecting dielectric substance of high relative dielectric constant. Leakage of high order harmonic wave can be prevented by applying resonance structures of high order harmonic waves. For example, a resonance structures of quarter electricity length of even order harmonic wave or of quarter electricity length of odd order harmonic wave. This can prevent stably the leakage of even order waves (such as second order harmonic wave or fourth order harmonic wave) to the outside, which may occur, when microwaves of 2.45 GHz are outputted from EM wave oscillator 5.

To prevent the even order waves (second or fourth order harmonic wave) from leaking outside, leakage prevention means for even order waves can be arranged on an amplifier outputted from EM wave oscillator 5. This leakage prevention means has a stub of λ/8 widths in the center path of the amplifier. For instance, when the center path is 4 mm width, a 11 mm width stub can prevent even order EM waves and can prevent the leakage of even order waves (the width can be calculated by (122/8)*0.7=11, where 122 (mm) is wavelength of 2.45 GHz wave, and 0.7 is reduction rate).

Resonance frequency can be adjusted by choosing the position, inner diameter, outer diameter, length, thickness, or dielectric constant of resonator 6. Leakage of EM waves can be thus inhibited efficiently in response to reaction state of combustion chamber by adjustment of resonance frequency. Location of resonator 6 can be in inside the mixer 7, on the input terminal 7A which is an input portion of high voltage pulses from high voltage pulse generator 10, or even both of them. In the latter case, one of resonators 6 has resonance structure of quarter electricity length of even order harmonic wave while other resonator 6 has that of odd order harmonic wave.

EM Wave Exterior Leakage Prevention Component

EM wave exterior leakage prevention component 60 is arranged on inner circumference surface of plughole PH for attaching an ignition plug or on outer circumference surface of plasma generator 1. As shown in FIG. 4, this component is arranged on outer circumference surface of plasma generator 1 in this embodiment. EM wave exterior leakage prevention component 60 shall be made of cylindrical cavity resonator similarly to resonator 6. Tip portion of exterior part of plasma generator 1, i.e., grounding outer case 70A in this embodiment, contacts with plughole PH to prevent EM waves from leaking from this portion. However, when a clearance is formed between outer case 70A and plughole PH due to discrepancies such as vibration. EM waves leak from outer case 70A (tip portion of the exterior pact of plasma generator 1). EM wave exterior leakage prevention component 60 therefore prevents EM waves from leaking outside of plughole PH when there is EM wave leak due to this kind of discrepancy. To prevent the leaking of EM waves to the outside, annular grounding component 61 can be arranged for grounding the plasma generator 1 to inner circumference surface of plughole PH as shown in FIG. 4, instead of using EM wave exterior leakage prevention component 60. Leakage of EM waves to the outside can be prevented much stably by arranging both grounding component 61 and EM wave exterior leakage prevention component 60. Grounding component 61 can be formed with a component that can fit to the clearance between, outer circumference surface of plasma generators 1 and inner circumference surface of plughole PH, and can be made of metal mesh, plate spring, or ring spring for example. Use of grounding component 61 suppresses movement of plasma generator 1 due to vibration inside plughole PH and can improve durability.

Operation of Internal Combustion Engine

Operation of internal combustion engine 11 including an operation of plasma generator 1 will be discussed.

Internal combustion engine 11 ignites air fuel mixture in combustion chamber 20 by microwave plasma generated by plasma generator 1 (this operation is referred to as "plasma ignition operation").

In each cylinder 24, intake stroke begins when intake valve 27 is opened just before piston 23 reaches top dead center. Then, exhaust stroke finishes when exhaust valve 28 is closed just after piston 23 passes the top dead center. Control device 4 outputs an injection signal to injector 29 of cylinder 24 in intake stroke to allow injector 29 to inject fuel.

Subsequently, intake stroke finishes when intake valve 27 is closed immediately after piston 23 passes a bottom dead center. Compression stroke begins when intake stroke finishes. Control device 4 outputs an ignition signal to a corresponding high voltage pulse generator 10 just before piston 23 reaches top dead center. High voltage poises outputted from ignition coil 3 are thereby supplied to ignition plug 8. Discharge plasma is therefore generated in discharge gap of ignition plug 8.

Control device 4 outputs an EM wave drive signal to EM wave oscillator 5 immediately after high voltage pulse generator 10 outputs high voltage pulses. Output timing of EM. wave drive signal can be adjusted based on combustor efficiency or operation mode, and EM wave can be oscillated at an intended timing.

EM wave drive signal is thus outputted to EM wave oscillator 5, and microwave pulses are oscillated from EM wave oscillator 5. Microwave pulse energy is supplied directly to mixer 7.

According to plasma generator 1 of present embodiment, microwave energy supplied to mixer 7 hardly leaks toward ignition coil 3 and EM wave oscillator 5 from resonator 6. Microwaves oscillated from EM wave oscillator 5 and supplied to resonator 6 resonate by resonance structure of resonator 6 which inhibits microwaves from leaking toward ignition coil 3 from resonator 6.

Discharge plasma created by spark discharge of ignition plug 8 of present internal combustion engine is enlarged by absorbing microwave energy and turns into comparatively large microwave plasma. Air-fuel mixture in combustion chamber 20 is ignited in volume using microwave plasma, and combustion of air-fuel mixture is thereby initiated.

In cylinder 24, piston 23 moves toward bottom dead center by expansive force of air-fuel mixture combustion. Exhaust stroke begins when exhaust valve 28 opens just before piston 23 readies the bottom dead center. Exhaust stroke finishes immediately after intake stroke begins as discussed above.

Advantage of the First Embodiment

Plasma generator in internal combustion engine of present embodiment allows mixing circuit to be installed compactly near ignition plug because a part of components of ignition plug is utilized as a part of components forming a mixer. This downsizes the plasma generator and allows convenient arrangement of plasma generator in restricted space inside the engine. Plasma generator of the present invention can reduce discharge energy loss and microwave energy loss because mixer and ignition plug are connected, and transmission line between the mixer and ignition plug is unnecessary. As a result, internal combustion engine of the present embodiment can reduce the fuel consumption by improvement of combustor efficiency

Modification 1 of the Embodiment

Figure 5:
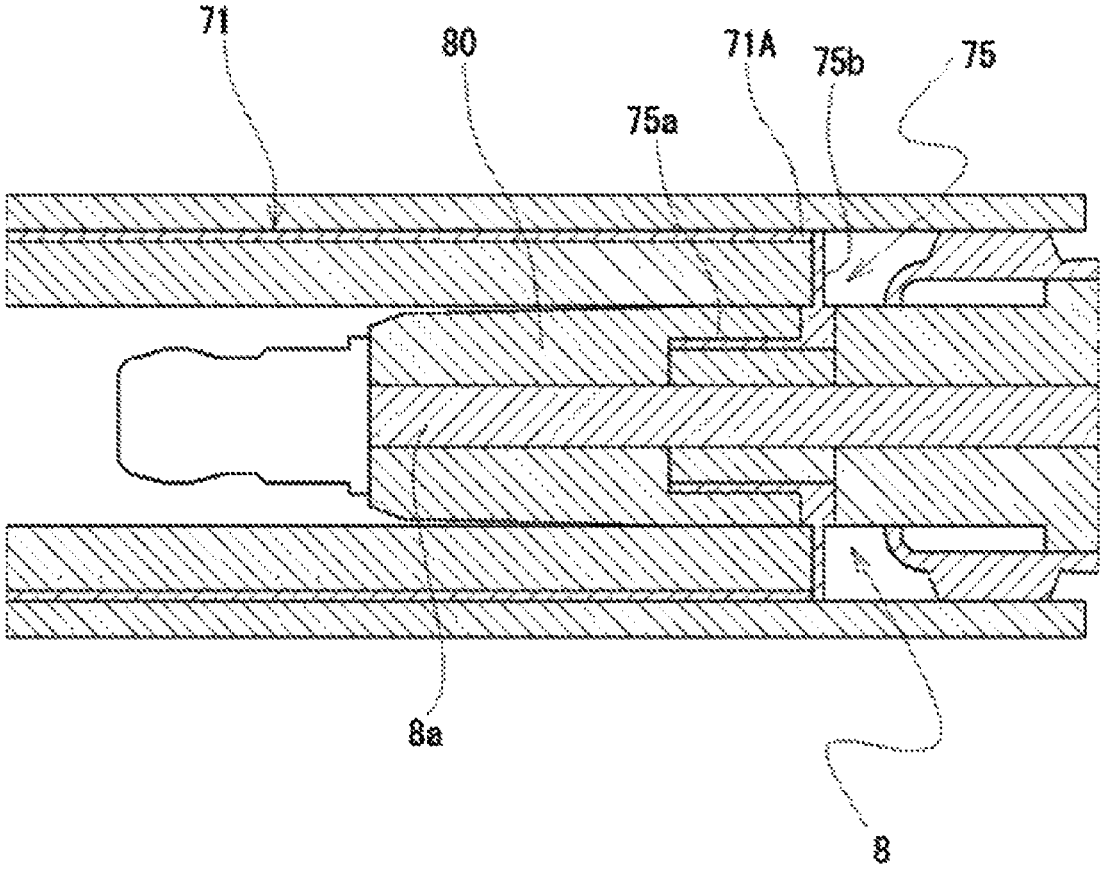
FIG. 5 is a partially notched sectional view of a ignition plug of a plasma generator according to a modification of an embodiment.

FIG. 5 illustrates a modification of connection pipe 71 of mixer 7 and ignition plug 8. Tubular internal floating electrode 75 can be arranged inside the insulator part 80 of ignition plug 8 so as to cover center electrode 8*a*. Internal floating electrode 75 is made of tubular electrode body 75*a* surrounding but isolated from center electrode 8*a*, and terminal part 75*b* extended like a disc from one annular end of electrode body 75*a* so as to project the surface of insulator part 80. Terminal part 75*b* is connected electrically with tip 71A of connection pipe 71 as shown in FIG. 5, and is capacity coupled to center electrode 8*a* together with electrode body 75*a*. Microwave from EM wave oscillator a is therefore transmitted to center electrode 8*a* efficiently by use of internal floating electrode 75.

Modification 2 of the Embodiment

Connection pipe of a mixer can be formed by combination of capacity type and coil type made of winding coil. Resonance frequency can be adjusted using both inductive element of transmission line and capacity element of connecting portion.

Winding type coil, can be used for a connection pipe of the mixer as another modification. Equivalent circuit is same as the previous examples: however, stray capacitance between center electrodes 8*a* and coil becomes the capacity of connection portion. Resonance frequency can be adjusted by controlling inductive element of transmission line.

Modification 3 of the Embodiment

Coupler can be formed of various other than the above examples. This is because a resonant circuit can be formed by parasitic capacitance occurred by an approach of transmission line and inductive element of the transmission line itself.

Second Embodiment

Plasma generator of the present embodiment further has a resonant circuit which resonate microwaves oscillated from EM wave oscillator 5. Plasma generator 1 can be adjusted so as to further improve the transmission efficiency of microwaves oscillated from EM wave oscillator 5 by including a resonant circuit for resonating microwaves.

INDUSTRIAL APPLICABILITY

As discussed above, present invention cars downsize a plasma generator equipping a mixing circuit and allows the plasma generator to be installed in restricted space of an engine because the mixing circuit can be located near a ignition plug. The plasma generator of the present invention further can reduce the discharge energy loss and the EM wave energy loss because the mixer and the ignition plug are connected directly. As a result, internal combustion engines, such as an automobile engine using the plasma generator of the present invention, can improve combustion efficiency and reduce the fuel consumption. Therefore, the plasma generator of the present invention or internal combustion engines using the plasma generator can be employed variously such as car, airplane, and vessel

DESCRIPTION OF THE REFERENCE NUMERALS

1 Plasma generator
2 DC power supply
3 Ignition coil
4 Control device
5 EM wave oscillator
6 Resonator
7 Mixer
8 Ignition plug
80 Insulator part
8*a* Center electrode
8*b* Earth electrode
9 Ignition part
10 High voltage pulse generator
11 Internal combustion engine
12 Internal combustion engine body

The invention claimed is:

1. A plasma generator comprising:

an ignition coil for supplying a discharge voltage;

an EM-wave oscillator for oscillating EM waves;

a mixer comprising a connection pipe to which the EM waves are supplied from the EM-wave oscillator and configured to mix an energy for discharge and an EM wave energy; and an ignition plug comprising an insulator, a center electrode, and a terminal and configured to cause the discharge and to introduce the EM wave energy to a reaction region where a combustion reaction or a plasma reaction is carried out, wherein the plasma generator initiates the combustion reaction and the plasma reaction in the reaction region using the energies of discharge and EM waves, and at least part of the connection pipe of the mixer is inserted into the ignition plug such that at least part of the insulator, the center electrode or the terminal that constitute the ignition plug forms an electrical coupling that constitutes part of the mixer in the ignition plug.

2. The plasma generator as claimed in claim 1, wherein the electrical coupling comprises a capacitive coupling or a combination of capacitive coupling and inductive coupling.

3. The plasma generator as claimed in claim 1, wherein the capacitive coupling includes a capacitor configured by tip part of a tubular transmission path of the mixer connected to the EM wave oscillator and a center electrode of the ignition plug.

4. The plasma generator as claimed in claim 1, wherein a resonator for preventing EM wave leakage is provided on a circuit connecting the ignition coil and the mixer.

5. The plasma generator as claimed in claim 4, wherein the resonator employs a resonance structure of either quarter electricity length of even order harmonic waves or quarter electricity length of odd order harmonic waves.

6. The plasma generator as claimed in claim 4, wherein the resonance frequency is adjustable by adjusting the position, inner diameter, outer diameter, length, thickness, or dielectric constant of the resonator.

7. The plasma generator as claimed in claim 1, wherein an EM wave exterior leakage prevention component is arranged on the inner circumference surface of a plug-hole for attaching the ignition plug or on the outer circumference surface of the plasma generator.

8. The plasma generator as claimed in claim 1, wherein a resonating circuit that resonate an EM wave oscillated from the EM wave oscillator.

9. The plasma generator as claimed in claim 8, wherein the resonating circuit employs a resonance structure of quarter electricity length of the EM wave oscillated from the EM wave oscillator.

10. The plasma generator as claimed in claim 1, further comprising:

an amplifying circuit which amplifies the EM wave outputted from the EM wave oscillator, wherein a stub having a width of ⅛ electricity length of the EM waves oscillated from the EM wave oscillator is provided in the center path of the amplifier.

11. An internal combustion engine comprising the plasma generator as claimed in claim 1.

* * * * *